United States Patent [19]

Williams

[11] 4,131,087

[45] Dec. 26, 1978

[54] FUEL INJECTION SYSTEM FOR AN INTERNAL COMBUSTION ENGINE

[75] Inventor: Malcolm Williams, Solihull, England

[73] Assignee: The Lucas Electrical Company Limited, Birmingham, England

[21] Appl. No.: 630,703

[22] Filed: Nov. 10, 1975

[30] Foreign Application Priority Data

Nov. 22, 1974 [GB] United Kingdom ..... 50805/74

[51] Int. Cl.[2] ..... F02M 51/00

[52] U.S. Cl. ..... 123/32 EA; 60/276; 60/285; 123/32 EE

[58] Field of Search ..... 60/276, 285; 123/32 EA, 123/32 EE

[56] References Cited

U.S. PATENT DOCUMENTS

| | | | |
|---|---|---|---|
| 3,430,616 | 3/1969 | Glockler et al. | 123/32 EA |
| 3,699,932 | 10/1972 | Aono et al. | 123/32 EA |
| 3,702,601 | 11/1972 | Gordon et al. | 123/32 EA |
| 3,815,560 | 6/1974 | Wahl et al. | 123/32 EA |
| 3,824,969 | 7/1974 | Edison | 123/32 EA |
| 3,910,241 | 10/1975 | Fujisawa et al. | 60/276 |
| 3,913,536 | 10/1975 | Lapple et al. | 123/32 EA |
| 3,919,983 | 11/1975 | Wahl et al. | 123/32 EE |
| 3,926,154 | 12/1975 | Williams | 123/32 EE |
| 3,955,363 | 5/1976 | Manderscheid | 60/285 |

FOREIGN PATENT DOCUMENTS

| | | | |
|---|---|---|---|
| 2255874 | 5/1974 | Fed. Rep. of Germany | 123/32 EE |

*Primary Examiner*—Martin P. Schwadron
*Assistant Examiner*—G. L. Walton
*Attorney, Agent, or Firm*—Holman & Stern

[57] ABSTRACT

A fuel injection system for a V- or flat-type internal combustion engine with split intake/exhaust systems, includes injectors respectively associated with the intake systems and a pair of transducers associated with either the intake systems or the exhaust systems. A control unit alternately energizes the injectors in known manner and the outputs from the control unit to the injectors are used to operate a multiplex circuit whereby the transducers are alternately connected to the control unit, to control the pulse length of the output pulses therefrom.

6 Claims, 1 Drawing Figure

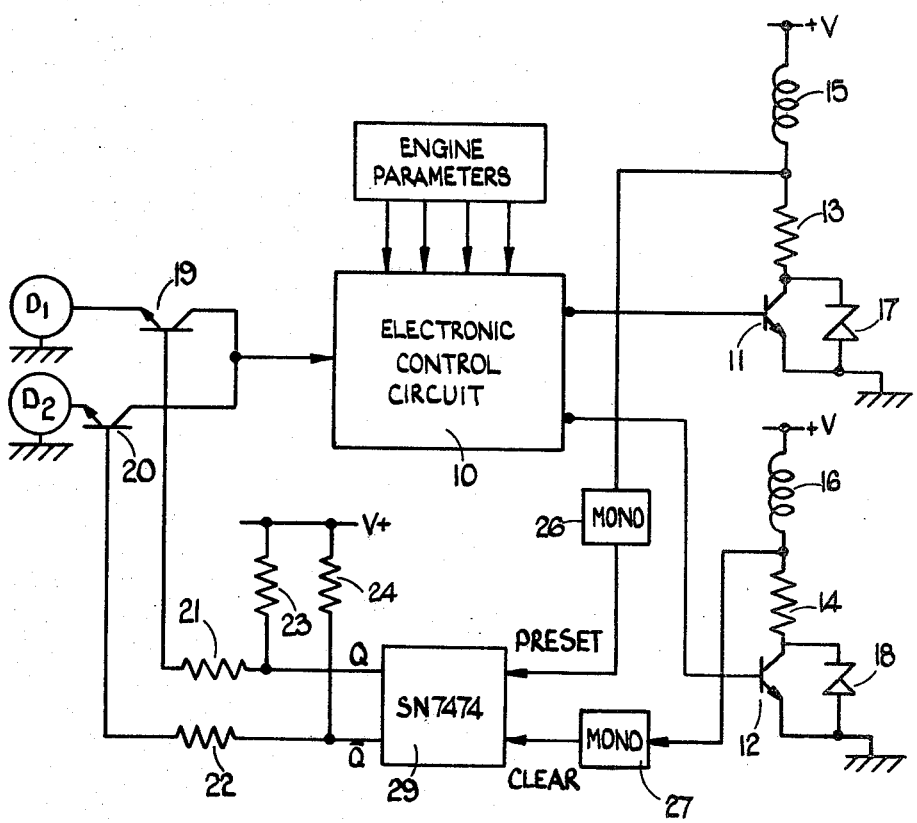
+V
15
ENGINE PARAMETERS
13
19
D1
ELECTRONIC CONTROL CIRCUIT
17
11
D2
20
10
+V
16
V+
26
MONO
24
21
23
14
PRESET
Q
18
SN7474
MONO
12
22
Q̄
29
CLEAR
27

FUEL INJECTION SYSTEM FOR AN INTERNAL COMBUSTION ENGINE

It has already been proposed to control the fuel injection to an internal combustion engine electronically using electromagnetic injector valves controlled by an electronic circuit sensitive to one or more engine operating parameters, such as engine speed, throttle angle, intake manifold pressure or air mass flow in the air intake.

Some engines — such as V-type engines — are constructed with two separate air intakes (which may open from a common inlet) and two separate exhaust systems (which may open into a common exhaust duct some distance away from the engine). When it is required to measure the air intake pressure, or the air intake air flow rate, or to measure the concentration of oxygen or a pollutant in the exhaust gas stream from the engine, the split intake and exhaust systems in such engines make such measurement difficult. Measuring the parameter concerned for one intake or exhaust system only may lead to inaccuracies.

It is an object of the invention to provide, for an engine having split intake and exhaust systems, a fuel injection system in a convenient form.

According to the invention a fuel injection system for an engine having split air intake and exhaust systems, comprises at least two electrically operated injectors associated with the intake systems respectively, a control unit for alternatively operating the injectors, said control unit including means for producing electrical output pulses of length dependent on an engine parameter, a pair of transducers for measuring said parameter, said transducers being associated with the two intake systems respectively or the two exhaust systems respectively, and a time-sharing multiplex circuit arrangement connecting said transducers to the control unit and operating in synchronism with the operation of the injectors so that the electrical outputs of the transducers are applied alternately to the control means.

The accompanying drawing shows the circuit diagram of one example of the invention.

The example shown in the drawing includes an electronic control circuit 10 which includes input terminals for the main fuel controlling signals derived from transducers sensing various engine operating parameters. The circuit 10 has two output terminals at which pulses appear alternately in synchronism with the engine. Each such pulse is of length dependent on the quantity of fuel required to be injected in the prevailing engine conditions. Each output terminal is connected to the base of an n-p-n transistor 11, 12 with its emitter grounded and its collector connected to a positive voltage supply rail via a resistor 13, 14 and solenoid 15, 16 in series respectively. The collector of each transistor is connected to the cathode of a zener diode 17, 18 the anode of which is grounded. The solenoids 15, 16 form part of two fuel injection valves which inject fuel into two separate air intake manifolds of the engine (which may either be of the V-type or the flat opposed type), such manifolds serving two groups of cylinders which have independent exhaust systems.

The circuit 10 also has a further input terminal to which a signal corresponding to the concentration of one specific component of the exhaust gas would be fed if the circuit 10 were used on an engine with a single exhaust system. For example, the control circuit may be designed to reduce the fuel flow to the engine when there is a rise in this input signal corresponding, say, to an increase in the carbon monoxide concentration.

In the present case two oxygen concentration detector devices $D_1$ and $D_2$ are provided in the two exhaust systems respectively. These have their electrical output terminals connected to the emitters of two n-p-n transistors 19, 20 which have their collectors connected to the further input terminal of the circuit 10. The bases of the two transistors 19, 20 are connected via resistors 21 and 22 respectively to the Q and $\overline{Q}$ output terminals of an integrated circuit bistable circuit 29. The Q and $\overline{Q}$ terminals are connected by resistors 23 and 24 to the supply rail. The preset and clear input terminals of the circuit 29 are connected via edge triggered monostable circuits 26, 27 to the interconnection of the resistor 13 and the solenoid 15 and to the interconnection of the resistor 14 and the solenoid 16 respectively.

Thus, in use, one of the two transistors 19, 20 is always conductive and the other is non-conductive. Each time a pulse issues from one of the output terminals of the circuit 10 to energise one or other of the solenoids 15, 16 the bistable circuit 29 changes state and the transistors 19, 20 change state from conducting to non-conducting or vice versa. Thus, a signal is always received at the further input terminal of the circuit 10 but this signal is derived alternately from the two detectors $D_1$, $D_2$.

It is to be understood that each solenoid 15, 16 may be replaced by a group of solenoids so that a better distribution of fuel in the associated air intake manifold is obtained.

I claim:

1. In an internal combustion engine having split air intake and exhaust systems, a fuel injection system therefor comprising at least two electrically operated injectors associated with the intake systems respectively, a control unit for alternately operating the injectors, said control unit including means for producing electrical output pulses of length dependent on an engine parameter, a pair of transducers for measuring said parameter, said transducers being associated with the two intake systems respectively, and a time sharing multiplex circuit arrangement connecting said transducers to the control unit and operating in synchronism with the operation of the injectors so that the electrical outputs of the transducers are applied alternately to the control means.

2. A system as claimed in claim 1, in which the multiplex circuit has input terminals connected to the control unit so that operation of an injector by the control unit effects a switching of the multiplex circuit between the transducers.

3. A system as claimed in claim 2, in which the multiplex circuit includes a pair of edge triggered monostable circuits having input terminals connected to the injectors, a bistable circuit having input terminals connected to said monostable circuits respectively and switch means driven by the bistable circuit and controlling the connection of the transducers to the control unit.

4. In an internal combustion engine having split air intake and exhaust systems, a fuel injection system therefor comprising at least two electrically operated injectors associated with the intake systems respectively, a control unit for alternately operating the injectors, said control unit including means for producing electrical output pulses of length dependent on an engine parameter, a pair of transducers for measuring said parameter, said transducers being associated with the two exhaust systems respectively, and a time sharing multiplex circuit arrangement connecting said transducers to the control unit and operating in synchronism with the operation of the injectors so that the electrical outputs of the transducers are applied alternately to the control means.

5. A system as claimed in claim 4, in which the multiplex circuit has input terminals connected to the control unit so that operation of an injector by the control unit effects a switching of the multiplex circuit between the transducers.

6. A system as claimed in claim 5, in which the multiplex circuit includes a pair of edge triggered monostable circuits having input terminals connected to the injectors, a bistable circuit having input terminals connected to said monostable circuits respectively and switch means driven by the bistable circuit and controlling the connection of the transducers to the control unit.

* * * * *